US011759925B2

(12) United States Patent
Sawa et al.

(10) Patent No.: US 11,759,925 B2
(45) **Date of Patent: *Sep. 19, 2023**

(54) TOOL FOR DRIVING A FASTENER

(71) Applicant: Milwaukee Electric Tool Corporation, Brookfield, WI (US)

(72) Inventors: Max R. Sawa, Palatine, IL (US); Christopher S. Hoppe, Milwaukee, WI (US); Aaron S. Blumenthal, Wauwatosa, WI (US); Caroline Hope, Milwaukee, WI (US); James Wekwert, Wauwatosa, WI (US); Bryan C. Ward, Wauwatosa, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 116 days.

This patent is subject to a terminal disclaimer.

(21) Appl. No.: 17/494,026

(22) Filed: Oct. 5, 2021

(65) Prior Publication Data

US 2022/0024004 A1 Jan. 27, 2022

Related U.S. Application Data

(63) Continuation of application No. 16/277,563, filed on Feb. 15, 2019, now Pat. No. 11,161,226, which is a (Continued)

(51) Int. Cl.

| | |
|---|---|
| ***B25B 21/00*** | (2006.01) |
| ***B25B 13/46*** | (2006.01) |
| ***B25B 23/00*** | (2006.01) |

(52) U.S. Cl.

CPC ..... *B25B 21/004* (2013.01); *B25B 13/462* (2013.01); *B25B 13/467* (2013.01); *B25B 21/007* (2013.01); *B25B 23/005* (2013.01)

(58) Field of Classification Search

CPC ... B25B 13/462; B25B 13/467; B25B 13/481; B25B 13/50; B25B 21/004; B25B 21/007; B25B 23/005; B25G 1/10; B25G 1/102

See application file for complete search history.

(56) References Cited

U.S. PATENT DOCUMENTS 2,482,387 A * 9/1949 Veneman ..... B25B 21/002 464/45
2,537,175 A 1/1951 Walter
(Continued)

FOREIGN PATENT DOCUMENTS

CN 1597260 3/2005
CN 101232974 7/2008
(Continued)

OTHER PUBLICATIONS

International Search Report and Written Opinion for International Application No. PCT/US2018/060027 dated Mar. 29, 2019, 18 pages.

(Continued)

*Primary Examiner* — David B. Thomas
(74) *Attorney, Agent, or Firm* — Reinhart Boerner Van Deuren s.c.

(57) ABSTRACT

A hand tool for driving a fastener is provided. The hand tool includes gearing that interconnects a splined socket to a rotatable or trigger actuator and increases a rotational speed of the splined socket relative to the actuator. The hand tool may include a power tool receiver or an independent motor to drive rotation of the splined socket to advance or retract a fastener from a threaded shaft. By increasing the speed and conserving rotational inertia, the hand tool reduces the time to secure a fastener on a threaded shaft. A rotatable nut is (Continued)

provided. The rotatable nut can slideably orient along a first axis and threadedly orient along a second axis to fasten to an adjacent surface.

17 Claims, 9 Drawing Sheets

Related U.S. Application Data continuation of application No. PCT/US2019/017686, filed on Feb. 12, 2019.

(60) Provisional application No. 62/629,842, filed on Feb. 13, 2018.

(56) References Cited

U.S. PATENT DOCUMENTS

| | | | | |
|---|---|---|---|---|
| 2,578,686 | A | 12/1951 | Fish | |
| 2,711,111 | A * | 6/1955 | Brame | B25B 21/004 81/63 |
| 3,620,105 | A * | 11/1971 | Batten | B25B 21/002 81/57.14 |
| 3,726,161 | A | 4/1973 | Williams et al. | |
| 4,043,228 | A | 8/1977 | Venezio | |
| 4,287,795 | A * | 9/1981 | Curtiss | B25B 21/002 81/57.3 |
| 4,374,479 | A * | 2/1983 | Minotti | B25B 23/101 81/57.3 |
| 4,506,567 | A | 3/1985 | Makhlouf | |
| 5,040,303 | A * | 8/1991 | Koerner | G01B 7/315 33/203.13 |
| 5,363,726 | A | 11/1994 | Smith | |
| 5,388,478 | A | 2/1995 | Castle | |
| 5,392,671 | A | 2/1995 | Hazzard | |
| 5,460,062 | A * | 10/1995 | Wilson, Jr. | B25B 13/48 81/57.3 |
| 5,522,285 | A | 6/1996 | Wilson et al. | |
| 5,537,897 | A | 7/1996 | Wilson | |
| 5,732,605 | A | 3/1998 | Mann | |
| 5,924,339 | A | 7/1999 | Huang | |
| 6,474,201 | B1 * | 11/2002 | Lund | B25B 23/0035 81/124.2 |
| 6,945,139 | B1 | 9/2005 | Johnson | |
| 7,272,996 | B2 * | 9/2007 | Pontieri | B24B 45/003 81/90.1 |
| 7,703,356 | B2 | 4/2010 | Bass | |
| 7,934,440 | B2 | 5/2011 | Samudosky | |
| 8,322,255 | B1 * | 12/2012 | Jordan | B25B 23/0085 81/57.32 |
| 9,067,309 | B2 | 6/2015 | McMenemy | |
| 9,899,787 | B2 * | 2/2018 | Baumler | B25B 13/08 |
| 10,926,381 | B2 | 2/2021 | Wilson | |
| 2004/0074344 | A1 | 4/2004 | Carroll | |
| 2008/0066584 | A1 * | 3/2008 | Vines | B25B 13/481 81/124.2 |
| 2008/0245193 | A1 * | 10/2008 | Lipka | B25B 13/107 81/58.2 |
| 2009/0178517 | A1 * | 7/2009 | Forrester | B25B 13/06 81/124.2 |
| 2011/0000342 | A1 | 1/2011 | Lambert et al. | |
| 2013/0032007 | A1 | 2/2013 | Chen | |
| 2013/0239755 | A1 | 9/2013 | Khangar et al. | |
| 2014/0182420 | A1 | 7/2014 | Chen et al. | |
| 2015/0375378 | A1 | 12/2015 | Hewitt et al. | |
| 2016/0031067 | A1 * | 2/2016 | Batt | B25B 13/08 81/57.29 |
| 2017/0259410 | A1 | 9/2017 | Chang | |

FOREIGN PATENT DOCUMENTS

| | | |
|---|---|---|
| CN | 202468628 | 10/2012 |
| JP | 05-042485 | 2/1993 |
| KR | 10-0641898 | 11/2006 |
| WO | WO92-14585 | 9/1992 |

OTHER PUBLICATIONS

International Search Report and Written Opinion for International Application No. PCT/US2019/017686, dated May 29, 2019, 14 pages.

* cited by examiner

TOOL FOR DRIVING A FASTENER

CROSS-REFERENCE TO RELATED PATENT APPLICATION

The present application is a continuation of U.S. application Ser. No. 16/277,563, filed Feb. 15, 2019 which is a continuation of International Application No. PCT/US2019/017686, filed Feb. 12, 2019, which claims the benefit of and priority to 62/629,842 filed on Feb. 13, 2018, which are incorporated herein by reference in their entireties.

BACKGROUND OF THE INVENTION

The present invention relates generally to the field of hand tools and fasteners. The present invention relates specifically to methods and mechanisms for increasing a speed of rotation for a hand tool. Tools and devices for quickly rotating a fastener about a threaded shaft are described.

SUMMARY OF THE INVENTION

One embodiment of the invention relates to a fastener driving tool. The fastener driving tool includes a housing, a drive member, a drive input, gearing, and a slot. The housing defines a handle. The drive member is coupled to the housing. The drive member includes a rotational axis extending through the drive member, an elongated hollow tube defining a continuous passageway through the drive member, and a first fastener-engaging end at a first end of the elongated hollow tube. The drive input is coupled to the drive member and configured to rotate the drive member within the housing. The drive input provides a speed of rotation for the drive member. Gearing interconnects the drive member to the drive input. The gearing has a gear ratio that increases a speed of rotation of the drive member relative to the speed of rotation of the drive input. The slot passes through the housing and the elongated hollow tube of the drive member. A length axis of the slot forms an opening in a direction parallel to the rotational axis when the slot through the housing and the slot through the elongated hollow tube are aligned in a direction transverse to the rotational axis. The opening form from the slot alignment receives a threaded shaft in the direction transverse to the rotational axis of the drive member. The opening width in the direction transverse to the rotational axis is greater than an outer diameter of the threaded shaft.

Another embodiment of the invention relates to a drive tool. The drive tool includes a housing, an input receiver, a torque receiving element, a drive member, and a removable insert. The input receiver is rotatably coupled to the housing and defines a first rotational axis. The torque receiving element is located on a face of the input receiver. The first rotational axis extends through the torque receiving element. The drive member is centered about a second rotational axis parallel to the first rotational axis. The drive member is rotatably coupled to the input receiver, and includes a drive surface that rotates when the input receiver rotates. The removable insert includes a connecting portion and a fastener-engaging portion opposite the connecting portion. The connecting portion of the removable insert removably couples to the drive surface of the drive member. The fastener-engaging portion of the removable insert engages a fastener. The input receiver rotates when an external torque is applied to the torque receiving element and rotates the input receiver. Rotation of the input receiver rotates the drive surface of the drive member that is removably coupled to the removable insert.

Another embodiment of the invention relates to a drive tool. The drive tool includes a housing, a handle, an input receiver, a torque receiving element, a drive member, and a removable insert. The housing has a first side and a second side opposite the first side. The input receiver has a first set of external gear teeth rotatably captured between the first side and the second side of the housing. The input receiver defines a first rotational axis. The torque receiving element is located on a face of the input receiver. The first rotational axis extends through the torque receiving element of the input receiver. The drive member with a second set of external gear teeth is intermeshed with the first set of external gear teeth of the input receiver. The drive member is centered about a second rotational axis parallel to the first rotational axis. The drive member includes a drive surface that rotates when the input receiver rotates. The removable insert includes a connecting portion and a fastener-engaging portion. The connecting portion of the removable insert couples to the drive surface of the drive member. The fastener-engaging portion of the removable insert engages a fastener. The input receiver rotates when an external torque is applied to the torque receiving element. Rotation of the input receiver rotates the drive surface of the drive member that is removably coupled to the removable insert.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Figure 1:
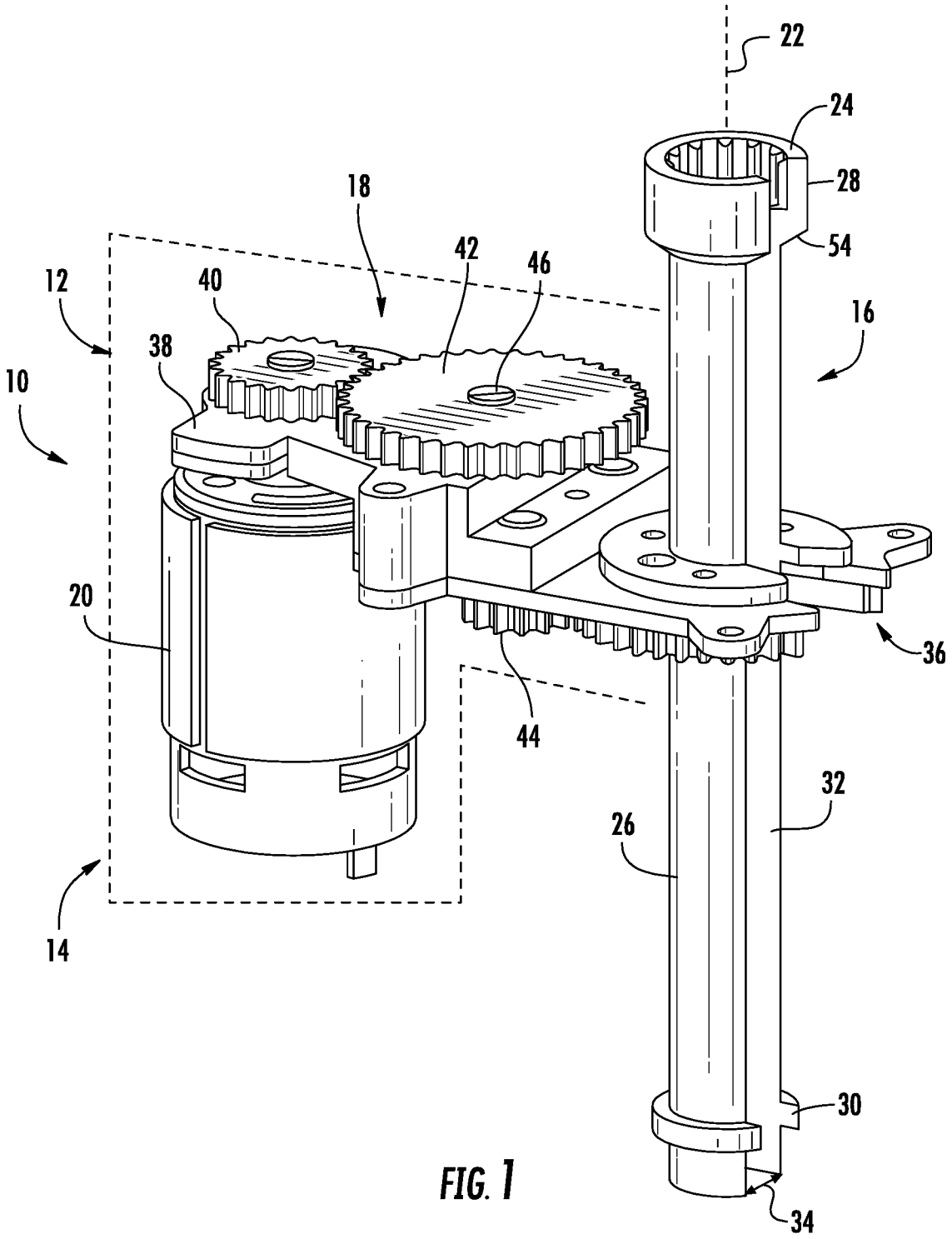
FIG. 1 is a top perspective view of a fastener driver tool according to one embodiment.

The figures generally illustrate various embodiments of a fastener driving tool. The fastener driving tool is a powered tool or a hand tool for fastening a fastener along a threaded shaft or screw a threaded shaft into an opening. For example, fastener driving tools may be used to attach a fastener to a rod, to drill a hole, and/or to screw a threaded shaft or shaft into a threaded or unthreaded opening. A drive member is driven by a drive input to rotate a fastener-engaging end to drive the fastener. In some embodiments, a motor within the fastener driving tool provides continuous rotation to the fastener-engaging end. Gearing between the drive input and the drive member increases the rotation speed and/or provides continuous rotation of the fastener-engaging end.

The drive tool includes an input receiver that receives an external torque at a torque receiving element. The torque receiving element increase the speed of rotation, e.g., from a power drill. The torque receiving element facilitates the use of an external motor to rotate the drive surface. For example, a power drill or other external tool inputs a torque at the torque receiving element to rotate the input receiver. Gearing intermeshes the input receiver with a drive member comprising drive surfaces that engage a fastener. The gearing creates a gear ratio that increases the rotational speed of the input torque at the drive surface. In some embodiments, gearing includes a transmission to change the gear ratio of the drive tool selectively.

The drive tool includes one or more removable inserts that interchange between the drive surface of the drive member to enable fastening a variety of different sized or shaped fasteners. The removable insert changes the location and/or the size of the drive surface. In this way, a power drill can use a single drill bit (e.g., a flathead or cross recess screwdriver bit) to rotate the torque receiving element of the input receiver to increase a speed of rotation at the drive surfaces. The input receiver is rotatably coupled to the drive member that rotates the drive surfaces engaged with the fastener.

Applicant has found that using a drive tool to rotate a drive surface enables the user to more quickly change the driving surface appropriate for the fastener. A removable insert enables changing the driven surfaces without changing the bit used at the torque receiving element to rotate the drive surface. In other words, the power tool attaches to different sized fasteners by making an attachment to the torque receiving element of the input receiver and size of the drive member is changed with different removable inserts to attach to different sized fasteners. This decreases the time to adjust the drive tool to receive different sized fasteners. In addition, gearing provides a gear ratio to increase an input speed of rotation at the torque receiving element to a higher output speed of rotation at the drive surface. The gearing increases the speed of rotation of the drive surface engaged with the fastener to more quickly fasten the fastener along a threaded shaft. In various embodiments, frustoconical sections and/or shoulders enable the threaded shaft to pass through the tool while orienting the fastener (e.g., nut) within the drive surface of the tool. This configuration enhances the speed of fastening the fastener by avoiding repositioning the fastener after each rotation.

Figure 2:
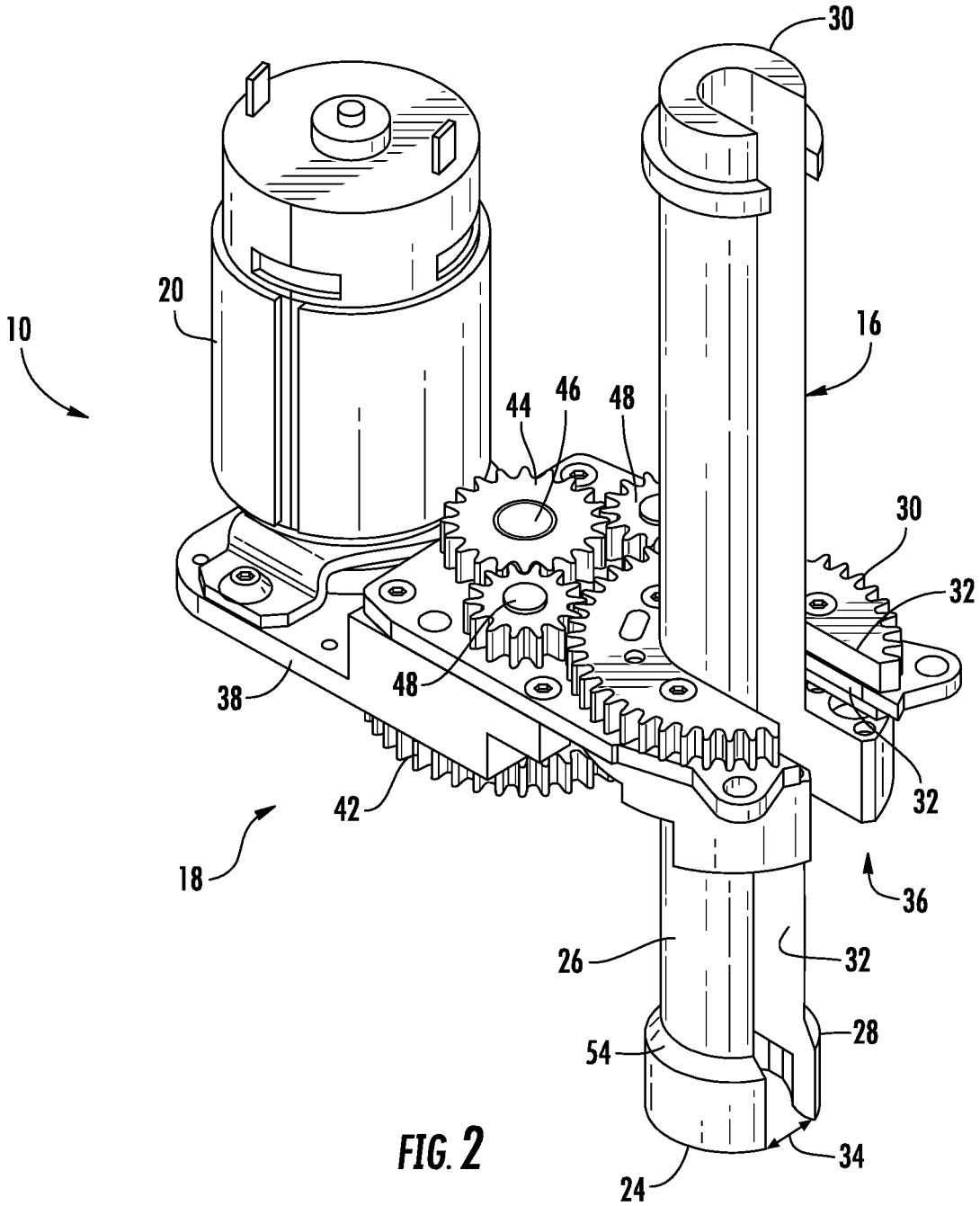
FIG. 2 is a bottom perspective view of the fastener driver tool of FIG. 1.

FIGS. 1 and 2 illustrate a fastener driving tool 10, according to one embodiment. The illustrated fastener driving tool 10 includes a housing 12 having a handle 14, a drive member 16 extending from the housing 12, and gearing or a drive mechanism 18 coupled to a drive input 20 for rotating the drive member 16 relative to the housing 12 about a longitudinal axis or rotational axis 22. The housing 12 is illustrated schematically in FIG. 1. Housing 12 may include a variety of different shapes, sizes, and/or configurations. In some embodiments, handle 14 extends parallel to the rotational axis 22 which provides the fastener driving tool 10 with a compact and ergonomic form factor.

The drive member 16 rotates about the rotational axis 22 and includes a fastener-engaging end 24 and an elongated hollow tube 26 extending from the fastener-engaging end 24. The elongated hollow tube 26 defines a continuous passageway extends through the drive member 16 along the rotational axis 22. The passageway is configured to receive a length of a threaded shaft when the fastener driving tool 10 is used to drive a fastener (e.g., a nut) along the threaded shaft. In other words, the threaded shaft passes axially through the drive member 16 to allow the fastener driving tool 10 to drive the fastener along any length of the threaded shaft.

Drive member 16 includes a fastener-engaging end 24 at a first end 28 of elongated hollow tube 26. The illustrated embodiment shows drive member 16 disposed on housing 12 away from drive input 20. In other embodiments, drive member 16 passes through drive input 20 and handle 14 is formed around the drive input 20 and the drive member 16. A continuous passageway is formed through drive input 20 and drive member 16 along the rotational axis 22 passing through a center of drive member 16. In some embodiments, drive member 16 includes a second fastener-engaging end 24 at a second end 30 opposite the first end 28 along the rotational axis 22 of the elongated hollow tube 26.

The illustrated drive member 16 also includes a slot 32 that extends into the continuous passageway along the entire length of the drive member 16. The slot 32 has a width 34 in the direction transverse to the rotational axis. The width 34 is at least slightly larger than a major diameter of the threaded shaft, such that the threaded shaft is inserted into the continuous passageway in a direction transverse to the rotational axis 22. Accordingly, the drive member 16 can engage a fastener at any point along a threaded shaft, without having to pass the end of the rod through the fastener driving tool 10.

The slot 32 passes through both the housing 12 and the elongated hollow tube 26 of the drive member 16. The slot 32 includes a length axis or longitudinal axis parallel to rotational axis 22. Slot 32 forms an opening 36 in a direction parallel to the rotational axis 22 when the slots 32 through housing 12 and elongated hollow tube 26 are aligned in a direction transverse to the rotational axis 22. In other words, opening 36 is formed when the slot 32 of the housing 12 aligns with the slot 32 in the elongated hollow tube 26. The opening 36 receives a threaded shaft in a direction transverse to the rotational axis 22 of the drive member 16. The width 34 of the slot 32 and/or the opening 36 is selected to be greater than an outer diameter of the threaded shaft.

A sensor 52 generates a signal indicative of alignment of the slot 32 through housing 12 and elongated hollow tube 26 of drive member 16. When slot 32 is aligned, opening 36 is formed in a direction parallel to rotational axis 22 and sensor 52 generates a signal to the drive input 20 (e.g., electric motor) to stop rotation of drive member 16 within housing 12. In this way, the drive input 20 selectively controls the rotation of the drive member 16 based on the signal to form the opening 36 through housing 12 and elongated hollow tube 26 of the drive member 16.

Drive input 20 is coupled to the drive member 16 via gearing and/or drive mechanism 18. Drive input 20 rotates drive member 16 within housing 12 at an input speed of rotation. The illustrated drive mechanism 18 includes an electric drive input 20 (e.g., a brushed or brushless DC electric motor) mounted to a support frame 38. A pinion 40 is driven by an output of the electric drive input 20 and disposed on a first side of the support frame 38. Pinion 40 meshes with and drives a first idler gear 42 rotatably coupled to a second idler gear 44 for co-rotation with the first idler gear 42. The second idler gear 44 is disposed on an opposite side of the support frame 38 from the first idler gear 42 and is coupled to the first idler gear 42 by an intermediate shaft 46 that extends through support frame 38. Second idler gear 44 meshes with one or more spur gears 48 (FIG. 2). Spur gears 48 mesh with a driven gear 50 that is coupled for co-rotation with drive member 16. Driven gear 50 is coupled to elongated hollow tube 26. Driven gear 50 can be integral to elongated hollow tube 26 and formed on an exterior surface of elongated hollow tube 26. Driven gear 50 includes a slot 32, as shown in FIG. 2. Driven gear 50 may be formed as an integral part of elongated hollow tube 26, such that the elongated hollow tube 26 forms slot 32. Opening 36 forms when the slots 32 through the driven gear 50, elongated hollow tube 26, and housing 12 are all aligned.

Drive mechanism 18 is configured to provide a speed increase from the drive input 20 to the drive member 16. For example, gearing along drive mechanism 18 interconnects drive member 16 to drive input 20. The drive mechanism 18 gearing has a gear ratio that increases the speed of rotation of drive member 16 relative to the speed of rotation of drive input 20. In some embodiments, drive mechanism 18 includes a transmission (not shown) intermeshed with gearing that interconnects the drive member 16 to the drive input 20. In this configuration, the transmission enables selectable gear ratios between the drive input 20 and the drive member 16. A gear ratio of 2:1 indicates that for each full rotation of drive input 20, the drive member 16 completes two rotations. For example, the gear ratio is between 1.5:1 and 4:1, the gear ratio is between 2:1, and 3.5:1, or the gear ratio is between 2.5:1 and 3:1. The transmission enables a user to select one gear ratio for one application and a second gear ratio for another application.

As illustrated in FIG. 2, driven gear 50 includes a slot 32 that extends radially inward to the center of the driven gear 50. Thus, the driven gear 50 has a gap in its external gear teeth where slot 32 is located. In some embodiments, the slot 32 in driven gear 50 is coincident with the slot 32 in the elongated hollow tube 26. Housing 12 and/or support frame 38 also include a slot 32 that, in the illustrated embodiment, is the same width 34 as the slot 32 in the driven gear 50. The width 34 of slot 32 is preferably at least slightly larger than an outer diameter of elongated hollow tube 26 so that drive member 16 can be removed and/or replaced from the fastener driving tool 10 through opening 36 created by aligning slots 32. Drive member 16 can then be interchanged with other drive members of different sizes, for example. The spur gears 48 are spaced from each other by a distance that is greater than the width of the slot 32 such that at least one of the spur gears 48 remains meshed with the driven gear 50. As the driven gear 50 rotates; however, the respective spur gears 48 disengage from the driven gear 50 as the slot 32 passes an opposing spur gear 48.

In operation when slots 32 align, an opening 36 is formed so that a user can insert a length of the threaded shaft into drive member 16. The user then positions a fastener (e.g., nut) on the fastener-engaging end 24 of elongated hollow tube 26. The user then energizes the drive input 20 (e.g., by pulling a trigger or powering an electric motor), which rotates the drive member 16 via drive mechanism 18 to advance the fastener along the threaded shaft. Engagement of the drive input 20 rotates the drive mechanism 18 and drive member 16 to rotate a fastener at the fastener-engaging end 24. In some embodiments, the fastener driving tool 10 includes a sensor 52 (FIG. 1) in connection with the driven gear 50 to detect when the slots 32 in support frame 38, housing 12, drive member 16, elongated hollow tube 26, and/or driven gear 50 are aligned to form opening 36. The sensor 52 stops the fastener driving operation to automatically form opening 36 and align slots 32 on the housing 12, drive member 16, elongated hollow tube 26, support frame 38, and/or driven gear 50 so that the fastener driving tool 10 can be removed from the threaded shaft and another threaded shaft inserted on elongated hollow tube 26.

The fastener-engaging end 24 is configured to drive a variety of different fastener types and sizes. For example, the fastener-engaging end 24 includes a shoulder 54 to prevent the fastener from traversing the elongated hollow tube 26. In some embodiments, the fastener-engaging end 24 is frustoconical. The frustoconical fastener-engaging end 24 has an inner diameter at a distal end relative to the housing 12 that is larger than an inner diameter at a proximate end relative to the housing 12.

Figure 3:
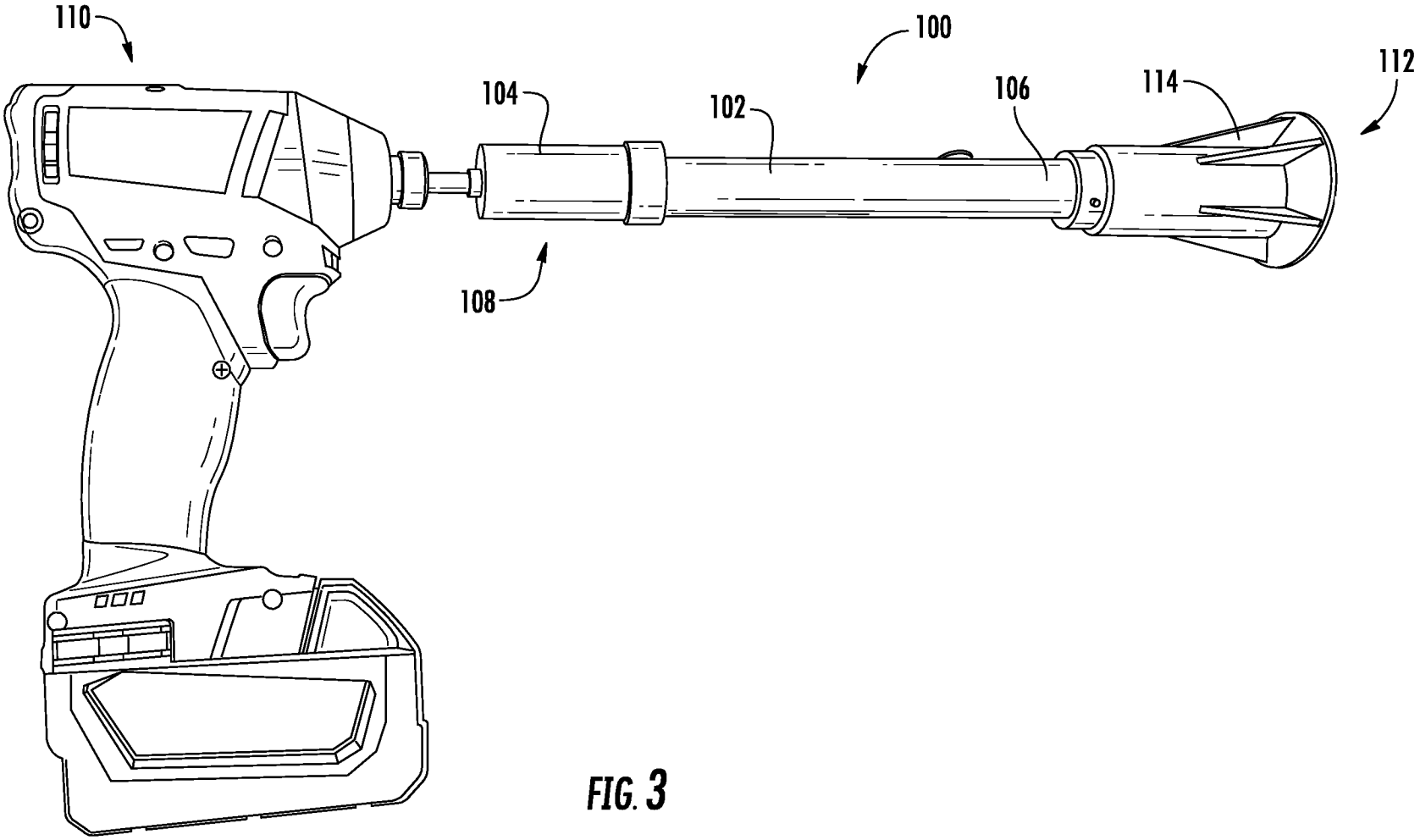
FIG. 3 is a perspective view of a power tool receiver, according to an exemplary embodiment.
Figure 4:
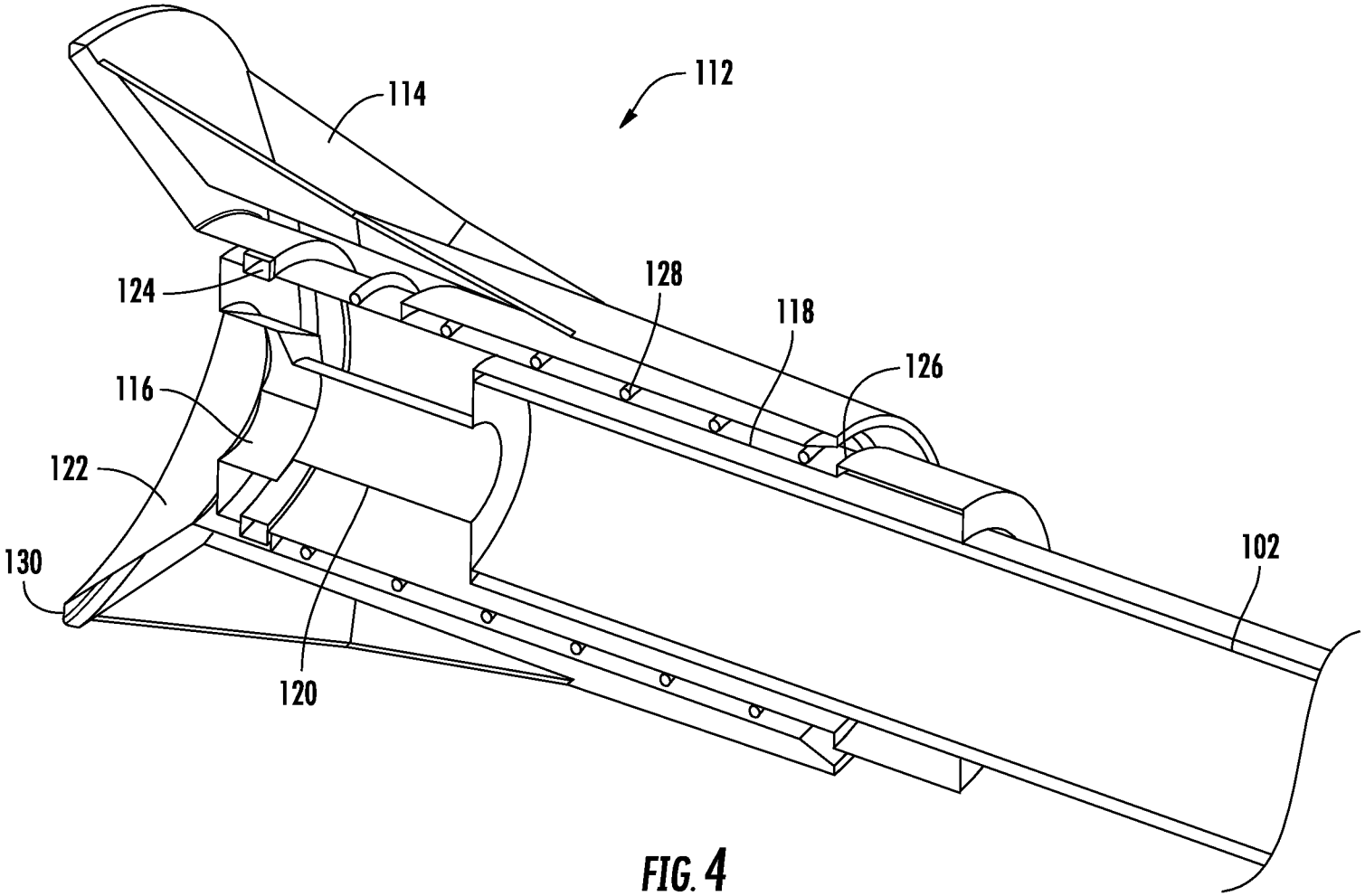
FIG. 4 is a cross-sectional view of a portion of the power tool receiver and a frustoconical section of FIG. 3.

The fastener driving tool 10 of FIGS. 1-2 can include features of power tool receiver 100 illustrated in FIGS. 3-4. In some embodiments, fastener driving tool 10 and/or power tool receiver 100 include a frustoconical inner guide 114 coupled to fastener-engaging end 24 of fastener driving tool 10 or second end 106 of power tool receiver 100. With reference to FIG. 4, the frustoconical inner guide 114 has a larger inner diameter at a first end, e.g., an outer edge 130 or shoulder, and a smaller inner diameter at a second end, e.g., at fastener-engaging feature 116. The larger diameter receives the fastener and orients the fastener through the frustoconical inner guide surface 122 to the smaller diameter. In the fastener-engaging feature 116, the fastener is oriented within the frustoconical inner guide 114. This frustoconical inner guide 114 structure helps to orient the fastener when it first engages the threaded shaft.

In some embodiments, fastener driving tool 10 includes an elongated removable insert 234 that is rigidly coupled to the fastener-engaging end 24 to extend the reach of the fastener-engaging end 24. For example, elongated removable insert 234 has a second fastener-engaging end 24 at a fastener-engaging feature 116 having an outer end spaced a distance from an outer end of the fastener-engaging end 24. The extended fastener-engaging end 24 at the fastener-engaging feature 116 is rotated as the fastener-engaging end 24 of the fastener driving tool 10 rotates.

In some embodiments, fastener-engaging end 24 couples to an attachment structure or removable insert 234 as illustrated in FIGS. 6-10. Removable insert 234 has a body 270 coupling a connecting portion or a connection end 240 to a fastener-engaging end 242 opposite the connection end 240. The connection end 240 removably couples to the fastener-engaging end 24 of the elongated hollow tube 26 and the body 270 of the removable insert 234 extends along the rotational axis 22 of the drive member 16. When input receiver 210 rotates in response to a torque applied at the torque receiving element 224, drive surfaces 230 rotate the removable insert 234 removably coupled to the drive member 212.

FIGS. 3 and 4 illustrate a power tool receiver 100 according to another embodiment. As shown in FIG. 3, power tool receiver 100 includes a hollow elongated member 102 having a first end 104 and a second end 106 opposite the first end 104. In the illustrated embodiment, an attachment structure 108 (e.g., a hexagonal shaft, a cylindrical shaft, a square shaft, etc.) is provided at the first end 104, allowing the power tool receiver 100 to be attached to an output of a power tool 110. The power tool receiver 100 provides a fastener positioning assembly 112 that includes one or more frustoconical inner guides 114 to position a fastener within a fastener-engaging feature 116.

FIG. 4 shows a detailed view of the fastener positioning assembly 112 coupled to elongated member 102 at the second end 106 of power tool receiver 100. The fastener positioning assembly 112 includes a collar 118 that surrounds the second end 106 of the elongated member 102. The collar 118 is secured to the elongated member 102 by a set screw, or by other methods, such as a cam-lock or other quick-connect fitting. Alternatively, the collar 118 is press fit on the elongated member 102. Collar 118 forms fastener-engaging feature 116 (e.g., a hexagonal recess) at a distal end of the collar 118 and a bore 120 that extends through the collar 118 and communicates with the interior of the hollow elongated member 102. The fastener positioning assembly 112 also includes frustoconical inner guide 114 coupled to and at least partially surrounding the collar 118. Frustoconical inner guide 114 includes a generally frustoconical inner guide surface 122 that extends outward from the fastener-engaging feature 116. The illustrated frustoconical inner guide 114 is coupled for generally linear movement along the collar 118, to an extent limited in the forward direction by a retaining ring 124 and in the rearward direction by a shoulder 126 on the collar 118. The collar 118 is biased forward by a spring 128. In operation, the frustoconical inner guide surface 122 of the guide 114 assists a user in guiding a fastener held in the fastener-engaging feature 116 on to a threaded shaft.

Alternatively, the frustoconical inner guide surface 122 assists the user in guiding the fastener-engaging feature 116 on to a rod for engagement with a fastener already positioned on a threaded shaft. The frustoconical inner guide 114 is movable rearward against the force of the spring 128, allowing the fastener-engaging feature 116 to move to a position flush with or, in some embodiments, extending beyond an outer edge 130 of frustoconical inner guide 114. The power tool receiver 100 can then be rotated (e.g., by operating the power tool 110 or manually rotating the power tool receiver 100) to drive the fastener along the threaded shaft. The power tool receiver 100 is particularly advantageous when advancing fasteners in an overhead orientation, such as when installing Unistrut.

In some embodiments, the elongated member 102 is a piece of standard sized conduit, such as electrical conduit, or standard sized pipe. In some embodiments, the elongated member 102 is interchanged with other elongated members of different lengths.

Figure 5:
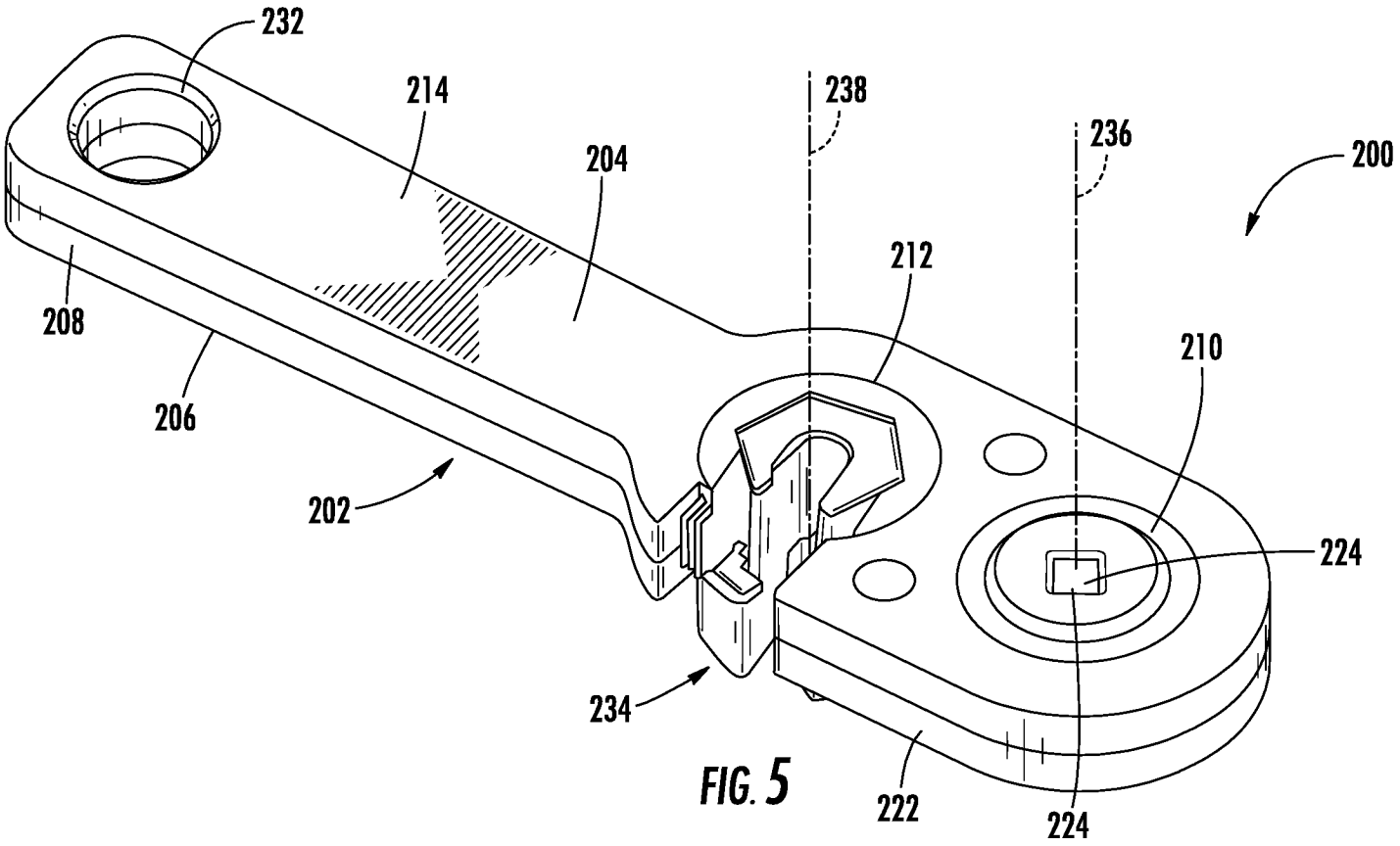
FIG. 5 is a perspective view of a driver tool, according to an exemplary embodiment.
Figure 6:
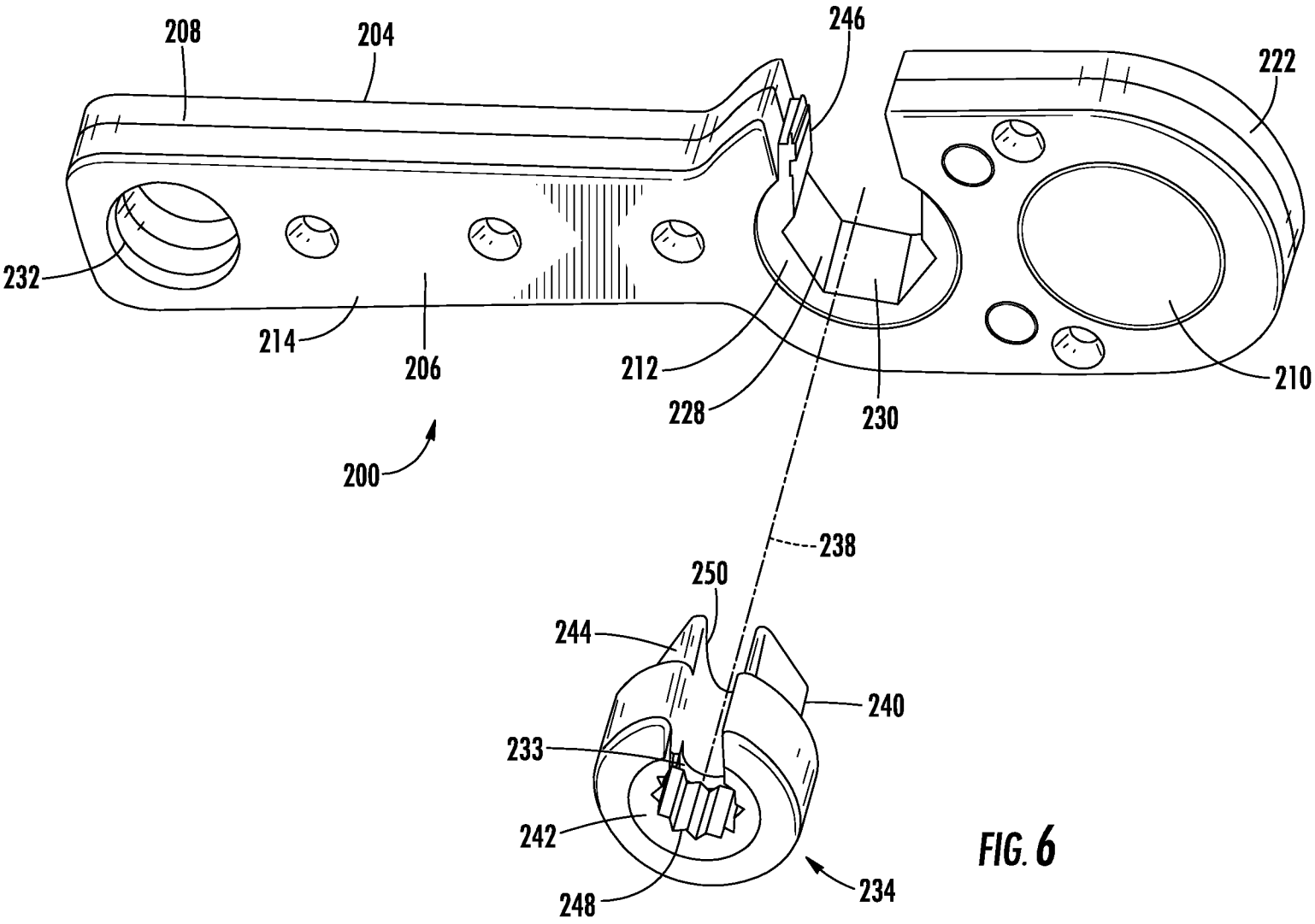
FIG. 6 is another perspective view of the driver tool of FIG. 5, with a removable insert, according to an exemplary embodiment.
Figure 7:
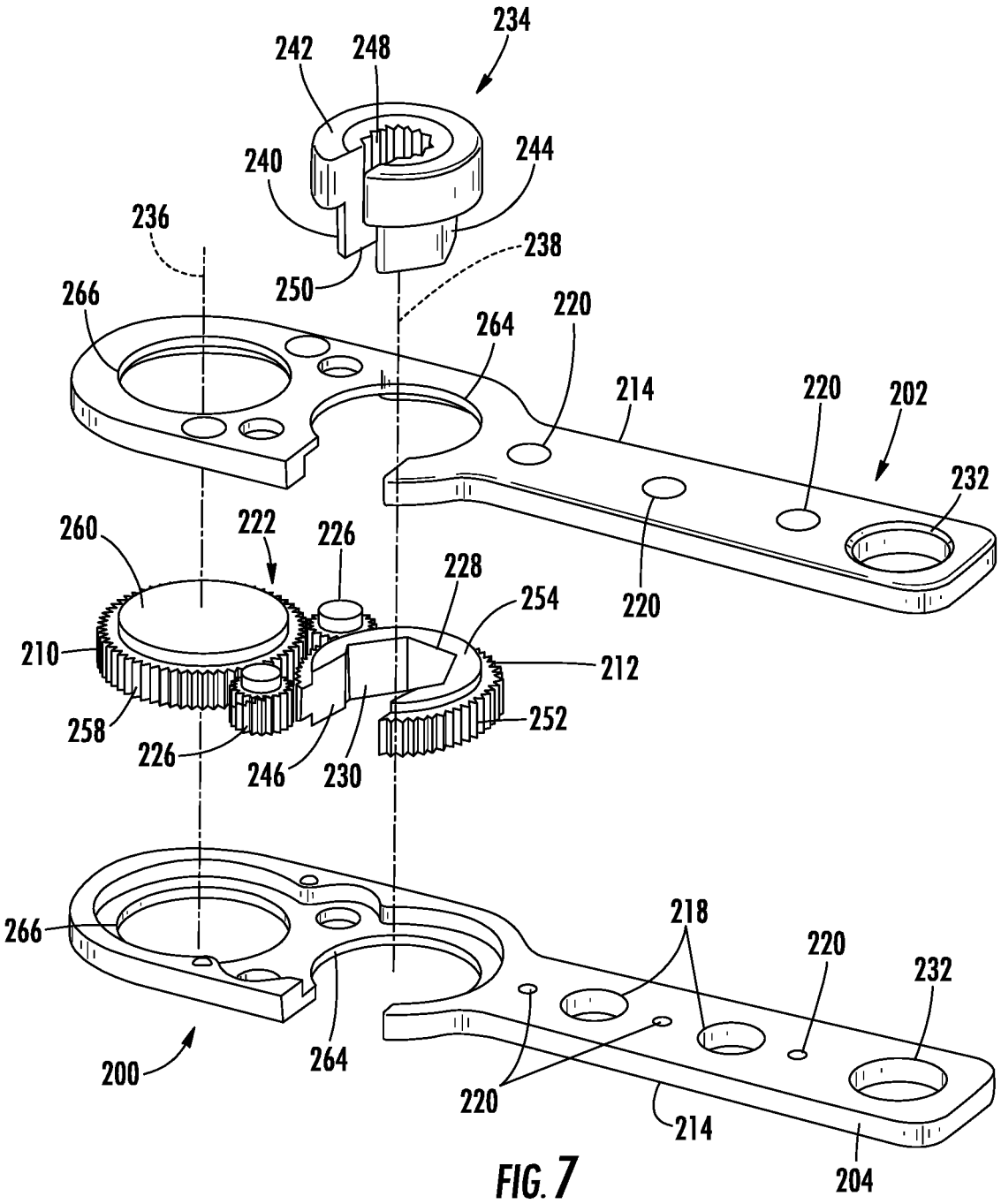
FIG. 7 is an exploded view of the driver tool of FIG. 5, according to an exemplary embodiment.
Figure 8:
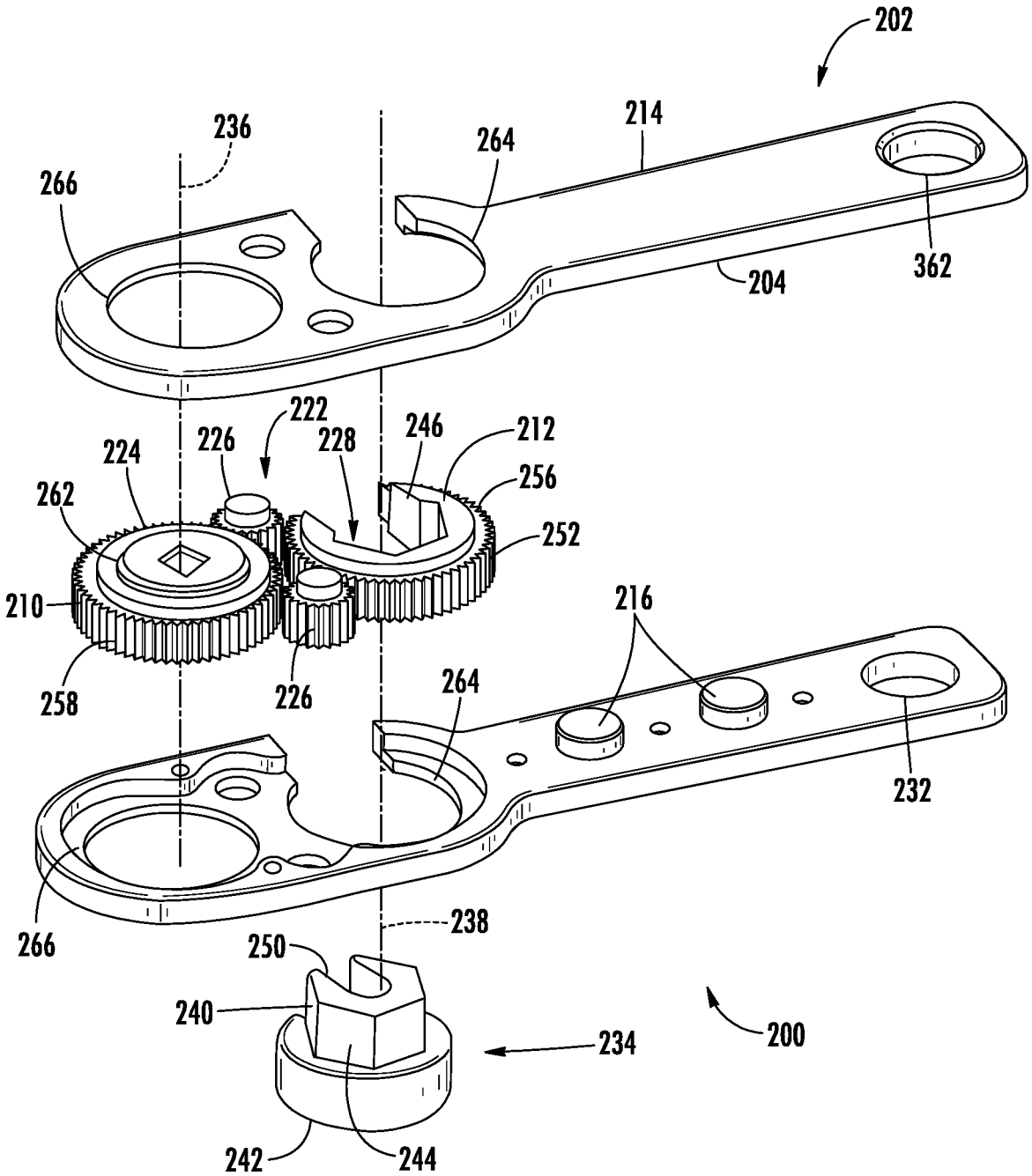
FIG. 8 is another exploded view of the driver tool of FIG. 5, according to an exemplary embodiment.

FIGS. 5-8 illustrate a drive tool 200 according to another embodiment. FIG. 5 illustrates a drive tool 200 that includes a housing 202 having an upper housing 204 and a lower housing 206 opposite the upper housing 204. Housing 202 forms a lateral side 208 extending between the upper housing 204 and the lower housing 206. The illustrated housing 202 is defined by upper housing 204 and cooperating lower housing 206 (FIGS. 7 and 8). Housing 202 includes an upper housing 204 coupled to a lower housing 206 that captures an input receiver 210 and a drive member 212 between upper housing 204 and lower housing 206. Housing 202 forms an outer grip or handle 214 that has a circular cross-sectional shape to facilitate gripping the handle 214.

With reference to FIGS. 7 and 8, the upper housing 204 includes alignment projections 216 (FIG. 8) that are received in the corresponding alignment recesses 218 (FIG. 7) in the lower housing 206. The upper housing 204 and lower housing 206 are further coupled together by fasteners (not shown), such as screws. In the illustrated embodiment, lower housing 206 includes a plurality of fastener bores 220, and the upper housing 204 includes a corresponding plurality of fastener bores 220 configured to align with the fastener bores on the lower housing. Fastener bores 220 on lower housing 206 are tapered to allow fasteners joining upper housing 204 and lower housing 206 to be countersunk (and therefore flush with or recessed below the upper housing 204). Coupling upper housing 204 and lower housing 206 via fastening, welding, brazing, adhesives, and the like, forms housing 202.

Returning to FIG. 5, housing 202 includes a handle 214 portion and a drive mechanism 222 extending from the handle 214. Drive mechanism 222 receives torque from a torque receiving element 224 located on a face of the input receiver 210 and transmits the torque through sprocket gears 226 to rotate drive member 212. An aperture 228 within drive member 212 forms a drive surface 230 that rotates as the drive member 212 is rotated by the input receiver 210. Handle 214 can include a bore 232. An attachment structure or a removable insert 234 can be removably coupled to drive member 212. The input receiver 210 is rotatably coupled to housing 202 and defines a first rotational axis 236 that extends through torque receiving element 224. Drive member 212 is centered about a second rotational axis 238 parallel to the first rotational axis 378. Drive member 212 is rotatably coupled to input receiver 210 so that a torque input at the torque receiving element 224 of the input receiver 210 rotatably drives or rotates drive member 212.

FIG. 6 shows another view of drive member 212. Drive member 212 includes an aperture 228 through the drive member 212 to form drive surface 230 that rotates in response to rotation of input receiver 210. Drive member 212 may have different forms or shapes to facilitate positioning a fastener or nut within the drive surfaces 230. For example, drive member 212 includes a smaller diameter within or at the end of drive member 212 to define a shoulder 233. Shoulder 233 is shaped to consistently position a nut concentrically within drive surfaces 230 of the drive member 212. Drive surface 230 may rotate a fastener directly and/or couple with removable insert 234 to rotate a fastener.

The drive tool 200 of FIGS. 5-8 can include features of power tool receiver 100 illustrated in FIGS. 3-4. In some embodiments, drive member 212 includes a frustoconical inner guide 114 (FIG. 3) formed on drive surface 230 and/or fastener-engaging end 242 of drive tool 200. The frustoconical fastener-engaging end 242 has a larger inner diameter at a first end (e.g., outer edge 130 of FIG. 3) and a smaller inner diameter at a second end (e.g., fastener-engaging feature 116 of FIG. 3). The frustoconical fastener-engaging end 242 is shaped to consistently position a nut concentrically within drive surfaces 230 of drive member 212. This frustoconical inner guide 114 structure helps orient the fastener when it first engages the threaded shaft and/or orient the drive surface 230 or fastener-engaging end 242 of drive tool 200 to receive the fastener along a part of the threaded shaft.

Referring to FIG. 6, handle 214 includes a bore 232 proximate an end of the handle 214 opposite the drive mechanism 222. The bore 232 provides a convenient attachment point for a lanyard (not shown). The drive mechanism 222 supports a drive member 212 and an input receiver 210. Input receiver 210 is rotatably coupled to housing 202 and defines and is rotatable about first rotational axis 236. The drive member 212 is rotatable about a second rotational axis 238 parallel to and offset from first rotational axis 236. Drive member 212 is rotatably coupled to housing 202 and input receiver 210. Drive member 212 includes a drive surface 230 that rotates in response to rotation of the input receiver 210.

The drive member 212 includes a drive aperture 228 extending through the drive member 212 along the second rotational axis 238. Drive surface 230 defines the perimeter of the drive aperture 228. Drive surface 230 is designed to drive a variety of different types and sizes of fasteners. For example, drive member 212 includes a drive surface 230 forming a flathead or cross-recess screwdriver bit configured for driving a screw. Drive surface 230 may include a recess or depression configured to drive a fastener (e.g., a nut) on a threaded shaft. In this configuration, drive surface 230 is a square shaped, hexagonally shaped, or octagonally shaped recess configured to receive an outer surface of the fastener. For example, drive surface 230 is hexagonally shaped to receive and rotate a hexagonal nut about second rotational axis 238.

Removable insert 234 couples to the drive surface 230 of the drive member 212. Removable insert 234 has a connection end 240 and a fastener-engaging end 242. An opening 246 extends through drive member 212 to the aperture 228. Opening 246 ensures that the threaded shaft or the fastener can easily slide in and out of drive member 212 to couple with drive surface 230 of the aperture 228. Opening 246 creates a gap in gearing surrounding drive member 212. The connection end 240 of removable insert 234 includes a driven surface 244 that slides through opening 246 to removably couple with drive surfaces 230. An aperture 248 through the removable insert 234 similarly extends to an opening 250 in the attachment structure to facilitate coupling the fastener-engaging end 242 with a fastener.

FIGS. 7 and 8 illustrate a detailed exploded view of components of drive tool 200. Drive member 212 includes opening 246, external gear teeth 252, a lower boss 254, and an upper boss 256. Opening 246 extends radially inward toward the center of the drive member 212. Opening 246 defines a gap in the external gear teeth 252. The input receiver 210 also includes external gear teeth 258, a lower boss 260, and an upper boss 262.

A face of input receiver 210 includes the torque receiving element 224. Torque receiving element 224 may extend through input receiver 210 defining a continuous bore. Torque receiving element 224 may create a partial depression or protrusion on the face of input receiver 210 to removably couple with a rotary input. First rotational axis 236 extends through torque receiving element 224 to define a center of rotation for input receiver 210. In some embodiments, torque receiving element 224 is a power tool receiver. For example, a power tool (e.g., a power drill) attaches to torque receiving element 224 to drive input receiver 210 and rotate drive member 212.

Torque receiving element 224 is configured with a variety of shapes and sizes. For example, torque receiving element 224 includes a straight or flat slot configured for a flathead screwdriver. Alternatively, torque receiving element 224 may include a cross-recess for receiving a cross-recess screwdriver head or bit. Torque receiving element 224 may be a protrusion or detent and include other shapes, such as a square, hex, or octagon. For example, torque receiving element 224 is a square-shaped recess in the illustrated embodiment and extends into lower boss 260 along the first rotational axis 236.

Rotary input such as torque from a motor or an output of a rotary power tool can be coupled to the torque receiving element 224 to drive the input receiver 210. For example, an electric motor can be coupled to input receiver 210 to rotate drive member 212. Alternatively, a power tool can couple to torque receiving element 224 to rotate the input receiver 210. In some embodiments, torque receiving element 224 may have other shapes (e.g., hex, spline, etc.) suitable for transmitting torque to the input receiver 210. Torque receiving element 224 may include a shaft or protrusion extending from input receiver 210.

With continued reference to FIGS. 7 and 8, the upper housing 204 and lower housing 206 of the housing 202 each include a drive member aperture 264 and an input member aperture 266. Drive member aperture 264 of lower housing 206 receives lower boss 254 of drive member 212. Drive member aperture of upper housing 204 receives upper boss 256 of drive member 212. Likewise, input member aperture 266 of lower housing 206 receives lower boss 260 of input receiver 210 and input member aperture 266 of upper housing 204 receives upper boss 262 of input receiver 210.

The inner periphery of each drive member aperture 264 on upper housing 204 and lower housing 206 acts as a bearing surface against the outer periphery of upper boss 256 and lower boss 254 of drive member 212, respectively. Similarly, the inner periphery on the upper housing 204 and lower housing 206 of each input member aperture 266 acts as a bearing surface against the outer periphery of upper boss 262 and lower boss 260 of input receiver 210, respectively. In this way, engagement of upper housing 204 with lower housing 206 forms drive member aperture 264 and input member aperture 266. Drive member aperture 264 captures upper boss 256 and lower boss 254 to maintain alignment and position of the drive member 212 in housing 202. Input member aperture 266 captures upper boss 262 and lower boss 260 to maintain alignment and position of input receiver 210 in housing 202.

Drive mechanism 222 connects the drive member 212 and the input receiver 210 such that rotation of the input receiver 210 rotates drive member 212. Input receiver 210 is centered about first rotational axis 236 and offset from drive member 212 centered about second rotational axis 238. The first rotational axis 236 is parallel to the second rotational axis 238. The illustrated drive mechanism 222 includes sprocket gears 226 (e.g., spur gears) meshed with external gear teeth 252 on drive member 212 and external gear teeth 258 on input receiver 210. Sprocket gears 226 are spaced from each other by a distance that is greater than the width of opening 246 in drive member 212, such that at least one sprocket gear 226 remains meshed with the external gear teeth 252 of drive member 212. As the drive member 212 rotates; however, each sprocket gear 226 respectively disengages from drive member 212 as opening 246 rotates past each sprocket gear 226.

Drive mechanism 222 includes gearing or other mechanical advantage systems between input receiver 210 and drive member 212. External gear teeth 258 on input receiver 210 rotate external gear teeth 252 on drive surface 230 through gearing intermeshed between the input receiver 210 and the drive member 212 (e.g., sprocket gears 226 and/or other gears). For example, drive mechanism 222 intermeshes the first set of external gear teeth 258 of the input receiver 210 with a second set of external gear teeth 252 on drive member 212. In some embodiments, input receiver 210 has different sets of external gear teeth 258. Drive member 212 can also have different sets of external gear teeth 252. Different sets of external gear teeth 252 and/or 258, additional sprocket gears 226, and/or other gears can be used to enable drive mechanism 222 to generate multiple gear ratios between input receiver 210 and drive member 212.

In some embodiments, drive mechanism 222 includes gearing between input receiver 210 and drive member 212 that is adjustable to provide different gear ratios. In such embodiments, the gearing of drive mechanism 222 interconnects input receiver 210 to drive member 212 and provides a first gear ratio. The first gear ratio rotates drive member 212 at a first speed relative to the rotation at the input receiver 210. Gearing of drive mechanism 222 can shift into a second gear ratio that rotates drive member 212 at a second speed relative to the rotation at the input receiver 210. The relative speeds of the gear ratios are different, such that a first speed associated with the first gear ratio is less than the second speed associated with the second gear ratio.

Drive tool 200 further includes removable insert 234 that is removably coupled to the drive member 212 to rotate drive surface 230 on fastener-engaging end 242 of removable insert 234. In the illustrated embodiment, removable insert 234 includes the connection end 240 and fastener-engaging end 242. Connection end 240 is insertable into drive aperture 228 and includes a plurality of driven surfaces 244 engageable with drive surfaces 230 of drive member 212. In some embodiments, one of drive member 212 or removable insert 234 includes a detent and other of drive member 212 or removable insert 234 includes a recess engageable with the detent to retain connection end 240 of the removable insert 234 within drive aperture 228. A shoulder 233 or protrusion retains connection end 240 within drive aperture 228 of drive member 212. Connection end 240 can also be friction fit within drive aperture 228 by providing a dimension of drive surfaces 230 that creates friction against drive aperture 228. Removable insert 234 may also be retained magnetically.

Figure 9:
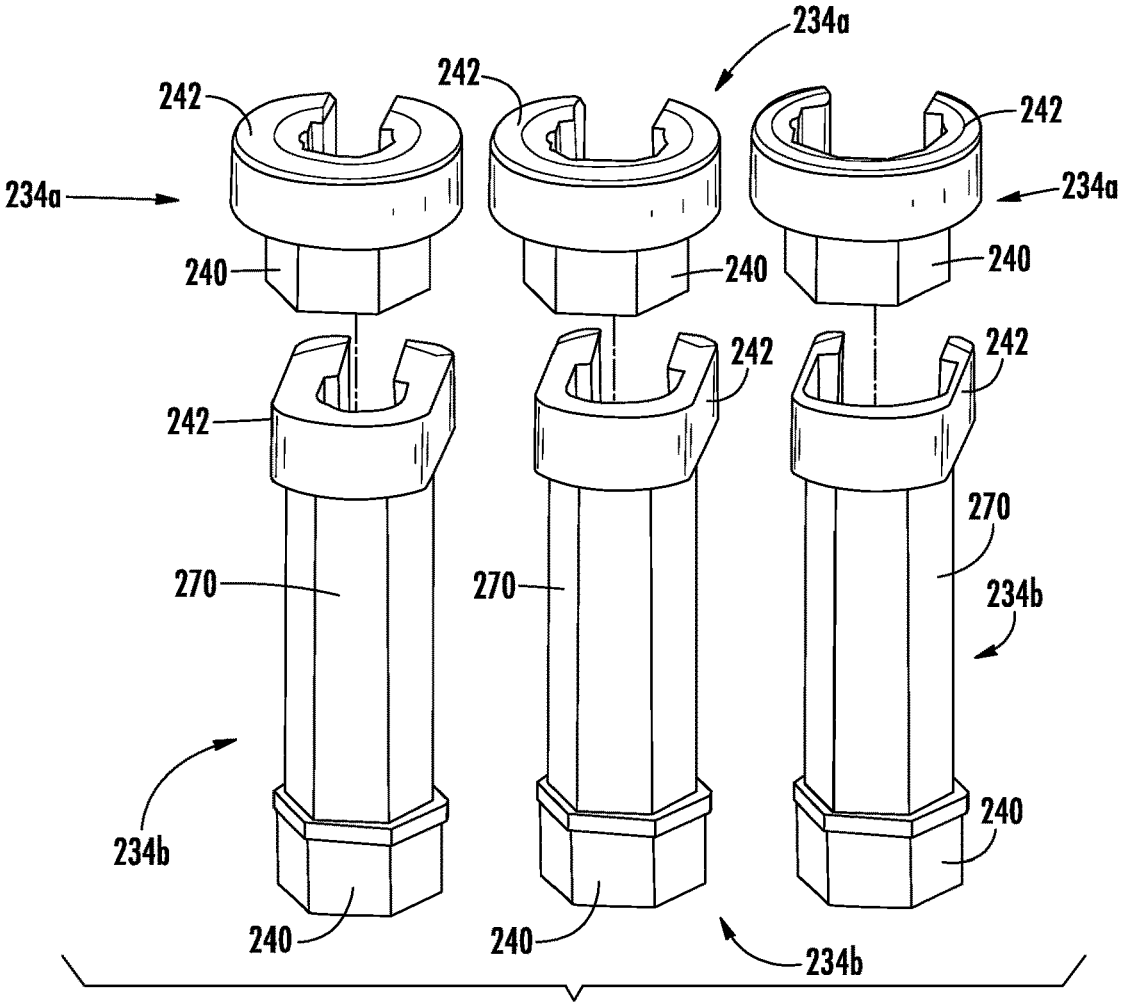
FIG. 9 is a set of removable inserts usable with the fastener driver tool of FIG. 5, according to an exemplary embodiment.

FIG. 9 illustrates a set of removable inserts 234 for drive tool 200. The set includes a plurality of compact removable inserts 234*a* and a plurality of extended removable inserts 234*b*. Each of removable inserts 234*a* and 234*b* preferably have an identical connection end 240 to couple with the drive surface 230 of drive member 212. Fastener-engaging ends 242 vary in size to suit a variety of applications. As shown in FIG. 9, removable inserts 234*a* and 234*b* can have different sized apertures 248 and/or openings 250. Fastener-engaging end 242 can vary in shape to form different shaped drive surfaces 230.

Figure 10:
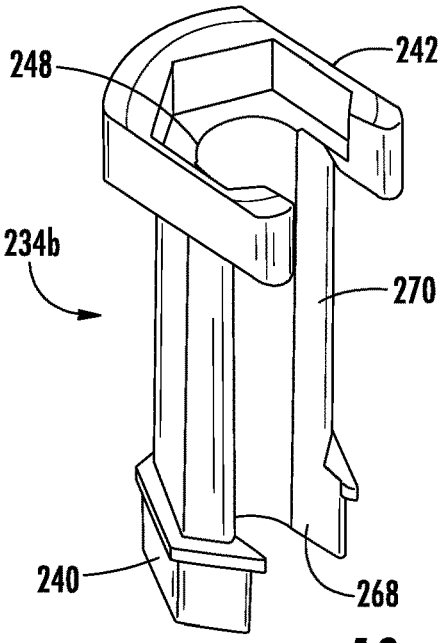
FIG. 10 is a perspective view of a removable insert from the set of FIG. 9, according to an exemplary embodiment.

The extended removable inserts 234*b* each includes an extension body 270 spanning between the connection end 240 and the fastener-engaging end 242. Compact inserts 234*a* have a fastener-engaging end 242 that is adjacent to connecting end 240. The aperture 248 extends through the body 270, such that the extension aperture 248 is hollow (FIG. 10). In the illustrated embodiment, slot 268 also extends along the entire length of body 270.

In operation, a user first selects a removable insert 234*a* or 234*b* from the set that has a fastener-engaging end 242 sized to receive a fastener. The user may select an extended removable insert 234*b* if a longer reach is required (e.g., if the fastener is deeply recessed), or the user may select a compact removable insert 234*a*. The user then pushes the connection end 240 of the removable insert 234*a* or 234*b* into the drive aperture 228 (FIG. 6). Next, the user positions fastener-engaging end 242 on the fastener. Openings 250 in removable insert 234 cooperates with opening 246 in drive member 212 to advantageously allow the drive tool 200 to engage a fastener located at any point along a threaded shaft, without having to pass an end of the threaded shaft through drive aperture 228. Next, the user rotates drive member 212 to advance the fastener. In some embodiments, the user rotates drive member 212 by rotating housing 202. Alternatively, the user rotates drive member 212 via input receiver 210. The user may connect a motor or a rotary power tool, for example, to torque receiving element 224 on input receiver 210 to quickly and efficiently advance the fastener.

FIG. 10 shows another embodiment of a removable insert 234. Fastener-engaging end 242 of the removable insert 234 includes a standard sized drive socket (with a star, hex, or any other desired geometry) that receive a standard fastener (e.g., a nut). Fastener-engaging end 242 couples to the fastener and advances the fastener along a threaded shaft. Removable insert 234 has an aperture 248 that extends through the removable insert 234 along a rotational axis. When removable insert 234 is coupled to drive member 212, aperture 248 is aligned with second rotational axis 238. A slot 268 extends radially inward to the center of the removable insert 234. The slot 268 is preferably aligned with the opening 246 of the drive member 212 when the removable insert 234 is coupled to drive member 212.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

While the current application recites particular combinations of features in the claims appended hereto, various embodiments of the invention relate to any combination of any of the features described herein whether or not such combination is currently claimed, and any such combination of features may be claimed in this or future applications. Any of the features, elements, or components of any of the exemplary embodiments discussed above may be used alone or in combination with any of the features, elements, or components of any of the other embodiments discussed above.

What is claimed is:

1. A fastener driving tool, comprising:

a housing;

a drive member coupled to the housing, the drive member comprising:

a rotational axis extending through the drive member;

an elongated hollow tube;

a first fastener-engaging end at a first end of the elongated hollow tube; and a second fastener-engaging end opposite the first fastener-engaging end along the rotational axis of the elongated hollow tube;

a drive input coupled to the drive member and configured to rotate the drive member within the housing, the drive input providing a speed of rotation;

gearing interconnecting the drive member to the drive input; and a slot through the housing and the elongated hollow tube of the drive member, a length axis of the slot forming an opening in a direction parallel to the rotational axis when the slot through the housing and the slot through the elongated hollow tube are aligned in a direction transverse to the rotational axis, the opening configured to receive a threaded shaft in the direction transverse to the rotational axis of the drive member, wherein the opening in the direction transverse to the rotational axis is greater than an outer diameter of the threaded shaft;

wherein the gearing has a gear ratio that increases a speed of rotation of the drive member relative to the speed of rotation of the drive input.

2. The fastener driving tool of claim 1, the first fastener-engaging end having an inner diameter at a distal end relative to the housing that is larger than an inner diameter at a proximate end relative to the housing.

3. The fastener driving tool of claim 2, wherein the first fastener-engaging end is a frustoconical fastener-engaging end.

4. The fastener driving tool of claim 1, further comprising a transmission intermeshed with the gearing interconnecting the drive member to the drive input, the transmission selectively changing the gear ratio between the drive input and the drive member.

5. The fastener driving tool of claim 4, further comprising an attachment structure having a body coupling a first connection end to the second fastener-engaging end opposite the first connection end, wherein the first connection end removably couples to the first fastener-engaging end of the elongated hollow tube and the body of the attachment structure extends along the rotational axis of the drive member.

6. The fastener driving tool of claim 1, wherein the drive input is an electric motor.

7. The fastener driving tool of claim 6, wherein the housing further defines a handle and wherein the drive member passes through the motor, and the handle is formed around the motor, the drive member forming a continuous passageway along a longitudinal axis passing through a center of the drive member.

8. The fastener driving tool of claim 6, further comprising a sensor that generates a signal indicative of alignment of the slot through the housing with the slot through the elongated hollow tube of the drive member in a direction parallel to the rotational axis, wherein the motor is configured to stop rotation of the drive member within the housing based on the signal to form the opening through the housing and the elongated hollow tube of the drive member.

9. A drive tool, comprising:

a housing;

an input receiver rotatably coupled to the housing defining a first rotational axis;

a torque receiving element located on a face of the input receiver, wherein the first rotational axis extends through the torque receiving element;

a drive member centered about a second rotational axis parallel to the first rotational axis, the drive member being rotatably coupled to the input receiver, the drive member comprising a drive surface configured to rotate when the input receiver rotates; and a removable insert coupled to the drive member;

wherein the input receiver is configured to rotate when an external torque is applied to the torque receiving element, rotation of the input receiver rotates the drive surface of the drive member removably coupled to the removable insert;

wherein the drive member further comprises a drive aperture extending through the drive member along the second rotational axis and wherein an opening extends radially inward through the drive member to the drive aperture.

10. The drive tool of claim 9, the removable insert further comprising a connecting portion and a fastener-engaging portion opposite the connecting portion, the connecting portion removably coupling to the drive surface of the drive member, the fastener-engaging portion configured to engage a fastener.

11. The drive tool of claim 10, wherein the removable insert includes an extension body between the fastener-engaging portion and the connecting portion and wherein the extension body includes a slot that extends along an entire length of the extension body.

12. The drive tool of claim 9, wherein the torque receiving element of the input receiver is a power tool receiver, wherein a power tool attaches to the input receiver to rotate the drive member.

13. The drive tool of claim 9, wherein the drive member includes a frustoconical fastener-engaging end, the frustoconical fastener-engaging end having a larger inner diameter at a first end and a smaller inner diameter at a second end and shaped to consistently position a nut concentrically within the drive surface of the drive member.

14. The drive tool of claim 9, wherein the drive surface of the drive member are square shaped and configured to receive and rotate a square nut about a second rotational axis.

15. The drive tool of claim 9, wherein the housing comprises an upper housing coupled to a lower housing, wherein the input receiver and drive member are captured between the upper housing and lower housing and the housing forms an outer grip that has a circular cross-sectional shape.

16. A drive tool, comprising:

a housing comprising a first side and a second side opposite the first side;

a handle;

an input receiver comprising a first set of external gear teeth rotatably captured between the first side and the second side of the housing, the input receiver defining a first rotational axis;

a torque receiving element located on a face of the input receiver, wherein the first rotational axis extends through the torque receiving element;

a drive member with a second set of external gear teeth intermeshed with the first set of external gear teeth of the input receiver, the drive member being centered about a second rotational axis parallel to the first rotational axis, the drive member comprising a drive surface configured to rotate when the input receiver rotates; and a removable insert;

wherein the input receiver is configured to rotate when an external torque is applied to the torque receiving element, rotation of the input receiver rotates the drive surface of the drive member removably coupled to the removable insert;

wherein, the handle further comprises a hole proximate an end of the handle opposite the drive member, the hole extending through the handle such that a lanyard can extend through the handle.

17. The drive tool of claim 16, wherein the handle forms an outer grip that has a circular cross-sectional shape.

* * * * *